US007789720B2

(12) United States Patent
Zinn

(10) Patent No.: US 7,789,720 B2
(45) Date of Patent: Sep. 7, 2010

(54) ELECTRICAL TERMINAL ASSEMBLY AND METHOD OF USING THE ELECTRICAL TERMINAL ASSEMBLY

(75) Inventor: Bernd Zinn, Ennepetal (DE)

(73) Assignee: Lear Corporation, Southfield, MI (US)

( * ) Notice: Subject to any disclaimer, the term of this patent is extended or adjusted under 35 U.S.C. 154(b) by 257 days.

(21) Appl. No.: 12/061,895

(22) Filed: Apr. 3, 2008

(65) Prior Publication Data

US 2008/0293287 A1 Nov. 27, 2008

(30) Foreign Application Priority Data

Apr. 3, 2007 (DE) ..... 10 2007 016 070

(51) Int. Cl.
*H01R 13/187* (2006.01)

(52) U.S. Cl. ..... 439/845; 439/370

(58) Field of Classification Search ..... 439/370, 439/845, 846

See application file for complete search history.

(56) References Cited

U.S. PATENT DOCUMENTS

| | | | | | |
|---|---|---|---|---|---|
| 2,701,350 | A | * | 2/1955 | Soreng | 439/849 |
| 3,654,594 | A | * | 4/1972 | Sitzler | 439/857 |
| 4,130,330 | A | | 12/1978 | Chandler | |
| 4,283,104 | A | | 8/1981 | Pemberton | |
| 4,302,649 | A | | 11/1981 | Ottersbach | |
| 4,934,965 | A | * | 6/1990 | Buddrus et al. | 439/845 |
| 5,033,982 | A | * | 7/1991 | Lucas | 439/750 |
| 5,342,226 | A | * | 8/1994 | Hayes et al. | 439/845 |
| 5,507,657 | A | | 4/1996 | Seto et al. | |
| 5,613,885 | A | * | 3/1997 | Plate et al. | 439/843 |
| 5,863,225 | A | * | 1/1999 | Liebich et al. | 439/845 |
| 5,897,406 | A | | 4/1999 | Benes et al. | |
| 5,921,821 | A | * | 7/1999 | Oka et al. | 439/845 |
| 6,102,752 | A | * | 8/2000 | Bommel et al. | 439/845 |
| 6,176,731 | B1 | | 1/2001 | Aoyama et al. | |
| 7,150,660 | B2 | * | 12/2006 | Allgood et al. | 439/845 |
| 7,241,189 | B2 | * | 7/2007 | Mohs et al. | 439/845 |
| 2002/0055297 | A1 | * | 5/2002 | Feeny, Jr. | 439/453 |
| 2003/0060090 | A1 | * | 3/2003 | Allgood et al. | 439/845 |

FOREIGN PATENT DOCUMENTS

| | | |
|---|---|---|
| DE | 40 00 568 | 8/1990 |
| DE | 41 31 470 | 7/1993 |
| DE | 697 01 476 | 11/2000 |
| EP | 0 651 464 | 5/1995 |
| EP | 0 820 120 | 1/1998 |
| EP | 0 823 756 | 2/1998 |
| EP | 1 248 318 | 10/2002 |
| EP | 1 429 424 | 6/2004 |

OTHER PUBLICATIONS

Office Action from German Patent and Trademark Office for corresponding DE Application 10 2007 016 070.6-34.

* cited by examiner

*Primary Examiner*—James Harvey
(74) *Attorney, Agent, or Firm*—Brooks Kushman P.C.

(57) ABSTRACT

An electrical terminal assembly is disclosed herein. The electrical terminal assembly includes a wire assembly receiving portion that is adapted to receive a wire assembly. The electrical terminal assembly further includes an electrical contact portion. The electrical contact portion is electrically connected to the wire assembly receiving portion. The electrical terminal assembly further includes a spring portion that is adapted to engage the electrical contact portion. The spring portion and the electrical contact portion cooperate to form a female receiver therebetween to engage and secure a male connector when the spring portion and the electrical contact portion are engaged.

19 Claims, 4 Drawing Sheets

ELECTRICAL TERMINAL ASSEMBLY AND METHOD OF USING THE ELECTRICAL TERMINAL ASSEMBLY

CROSS-REFERENCE TO RELATED APPLICATIONS

This application claims priority to German Application No. 10 2007 016 070.6, filed on Apr. 3, 2007, the disclosure of which is hereby incorporated in its entirety.

BACKGROUND OF THE INVENTION

1. Field of the Invention

This invention relates to an electrical terminal assembly and a method for using the assembly.

2. Background Art

An electrical terminal assembly is disclosed herein. Examples of electrical terminal assemblies are disclosed in U.S. Pat. Nos. 5,897,406; 4,283,104; 6,176,731; 5,507,657; 4,302,649; and 4,130,330.

SUMMARY OF THE INVENTION

Under the invention, an electrical terminal assembly is provided. In at least a first embodiment, the electrical terminal assembly includes a wire assembly receiving portion that is adapted to receive a wire assembly. An electrical contact portion that is electrically connected to the wire assembly receiving portion is also provided. Additionally, a spring portion adapted for engagement with the electrical contact portion is provided. The spring portion and the electrical contact portion cooperate to form a female receiver therebetween for engaging and securing a male connector when the spring portion and the electrical contact portion are engaged.

In at least on implementation of the first embodiment, the spring portion may be made, at least partially, from an electrically conductive material. For example, the spring portion may be made, at least partially, of steel.

In another implementation of the first embodiment, the electrical contact portion may be integral with the wire assembly receiving portion. In at least this implementation, the electrical contact portion and the wire assembly receiving portion may be made, at least partially, of copper.

In another implementation of the first embodiment, the electrical contact portion and the wire assembly receiving portion may be made, at least partially, of copper and the spring portion may be made, at least partially, of steel.

In another implementation of the first embodiment, the electrical contact portion may have an electrical contact portion protrusion that extends from a surface of the electrical contact portion toward the spring portion. The electrical contact portion protrusion and the spring portion may be configured to engage and secure the male connector within the female receiver. In a variation of this implementation, the electrical contact portion protrusion may contact the spring portion when the spring portion and the electrical contact portion are engaged. In this variation, the female receiver may be configured to secure the male connector through an interference fit between the spring portion, the electrical contact portion protrusion and the male connector.

In another implementation of the first embodiment, the spring portion may have a spring portion protrusion extending from a surface of the spring portion toward the electrical contact portion. The spring portion protrusion and the electrical contact portion may be configured to engage and secure the male connector within the female receiver. In at least one variation of this implementation, the spring portion protrusion may contact the electrical contact portion when the spring portion and the electrical contact portion are engaged. The female receiver may be configured to secure the male connector through an interference fit between the electrical contact portion, the spring portion protrusion and the male connector. In a further variation of this implementation, the electrical contact portion may have an electrical contact portion protrusion that extends from a surface of the electrical contact portion toward the spring portion. The electrical contact portion protrusion may be in contact with the spring portion protrusion when the spring portion and the electrical contact portion are engaged. Alternatively, the electrical contact portion protrusion may be spaced apart from the spring portion protrusion when the spring portion and the electrical contact portion are engaged.

In another implementation of the first embodiment, the electrical contact portion may have a plurality of electrical contact portion protrusions that extend from a surface of the electrical contact portion toward the spring portion. Similarly, the spring portion may have a plurality of spring portion protrusions extending from a surface of the spring portion toward the electrical contact portion. In another implementation, the spring portion is attachable to the electrical contact portion by a snap fit.

In at least a second embodiment, an electrical terminal assembly is provided. The assembly may include a wire assembly receiving portion that is adapted to receive a wire assembly having an insulated portion and an uninsulated portion. The wire assembly receiving portion may be made, at least partially, of copper and may have a first set of prongs for crimping around insulated portion of the wire assembly and a second set of prongs for crimping around the uninsulated portion of the wire assembly. Also provided is an electrical contact portion that may be made, at least partially, of copper. The electrical contact portion may be integral with the wire assembly receiving portion and may have an electrical contact portion protrusion that projects from a surface of the electrical contact portion. Also provided is a spring portion that may be attached by a snap fit to the electrical contact portion. The spring portion may be made, at least partially, of steel and may have a spring portion protrusion that protrudes from a surface of the spring portion toward the electrical contact portion. The spring portion protrusion may be spaced apart from the electrical contact portion protrusion, the spring portion and the electrical contact portion forming a female receiver configured to receive and secure a male connector.

In at least one implementation of the second embodiment, the spring portion protrusion may be composed of a plurality of substantially uniform, substantially aligned protrusion portions. In at least another implementation of the second embodiment, the electrical contact portion may have a plurality of spaced apart electrical contact portion protrusions.

In at least a third embodiment, a method of using an electrical terminal assembly having a wire assembly receiving portion that is adapted to receive a wire assembly having an insulated portion and an uninsulated portion, an electrical contact portion electrically connected to the wire assembly receiving portion, and a spring portion adapted for engagement with the electrical contact portion is provided. The method includes the step of placing the wire assembly in the wire assembly receiving portion of the electrical terminal assembly. The method further includes the step of crimping the wire assembly receiving portion around the insulated portion of the wire assembly. The method further includes the step of crimping the wire assembly receiving portion around the uninsulated portion of the wire assembly. The method further includes the step of attaching the spring portion to the electrical contact portion such that the spring portion and the electrical contact portion are configured to engage opposite sides of a male connector.

DETAILED DESCRIPTION OF THE PREFERRED EMBODIMENT(S)

Reference will now be made in detail to the illustrated embodiments of the present invention which include the best modes of practicing the invention presently known to the inventors. The following descriptions are merely exemplary in nature and in no way intended to limit the invention, its application, or uses. The Figures are not necessarily drawn to scale. Specific details disclosed herein are not to be interpreted as limiting, but merely as a representative basis for any aspect of the invention and/or as a representative basis for teaching one skilled in the art to variously employ the present invention.

Figure 1:
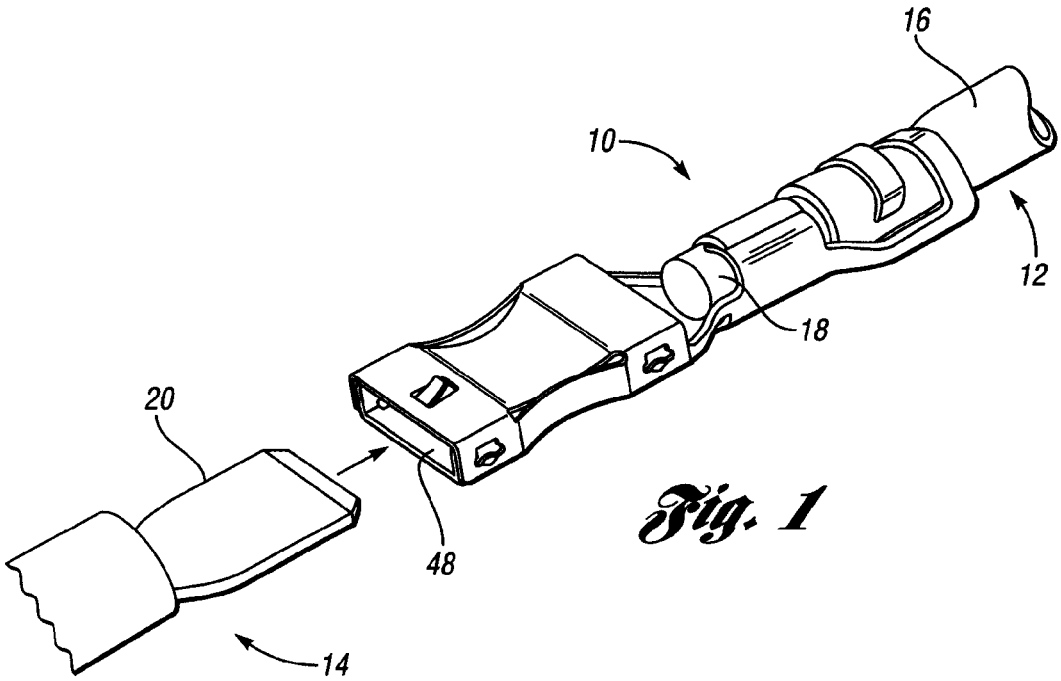
FIG. 1 is a perspective view of an embodiment of an electrical terminal assembly connected to a wire assembly, prior to attachment to an electrical component.

FIG. 1 illustrates an electrical terminal assembly 10 connected to a wire assembly 12, immediately prior to engaging an electrical component 14. The wire assembly 12 has an insulated portion 16 and an uninsulated portion 18. The uninsulated portion 18 may be made of any electronically conductive material, including copper. The electrical component 14 includes a male connector 20 configured to engage the electrical terminal assembly 10. In the configuration illustrated in FIG. 1, electric current passes from the wire assembly 12 through the electrical terminal assembly 10 and further through the male connector 20 into the electrical component 14. The electrical terminal assembly 10 illustrated in FIG. 1 can be used alone or together with similar assemblies as part of a wire harness. The electrical terminal assembly 10 may be used in any environment requiring the transmission of electricity from a wire to an electrical component. For example, in an automotive vehicle the electrical terminal assembly 10 may be used to route power from a power supply such as a car battery to a vehicle component such as an air conditioning compressor, a coolant fan, and the like.

Figure 2:
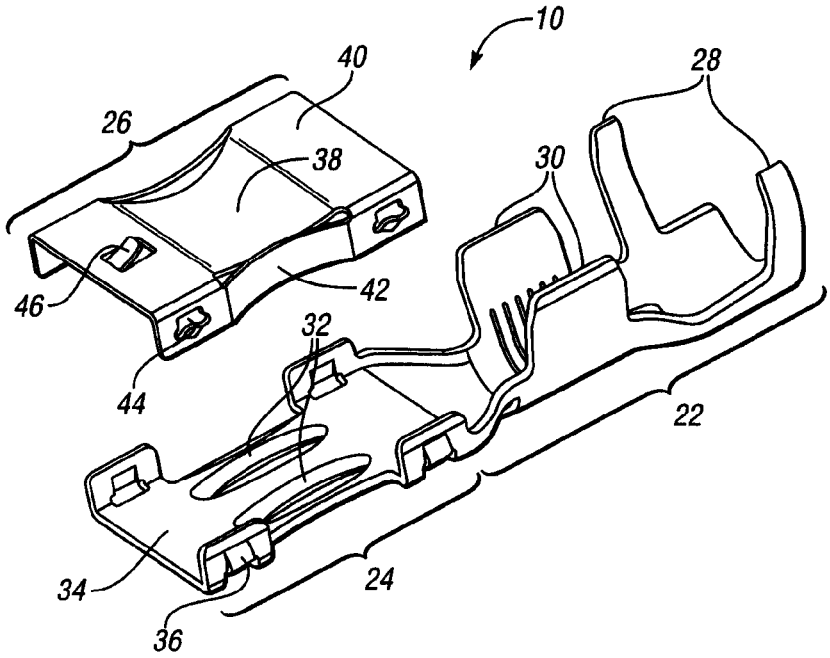
FIG. 2 is an exploded view of the electrical terminal assembly of FIG. 1.

FIG. 2 illustrates an exploded view of the electrical terminal assembly of FIG. 1. As illustrated, electrical terminal assembly 10 includes a wire assembly receiving portion 22, an electrical contact portion 24 and a spring portion 26. The wire assembly receiving portion 22 is generally configured to receive wire assembly 12 and includes a first set of prongs 28 and a second set of prongs 30. The first set of prongs 28 may be used to engage and secure wire assembly 12 by crimping around the insulated portion 16, thereby mechanically engaging and securing wire assembly 12 with an interference fit. The second set of prongs 30 may be used to engage and secure the uninsulated portion 18 of the wire assembly 12 by crimping around the uninsulated portion 18. The crimping of the second set of prongs 30 further mechanically engages and secures wire assembly 12 to electrical terminal assembly 10, and also creates an electrical connection between wire assembly 12 and electrical terminal assembly 10 through physical contact between the uninsulated portion 18 and the second set of prongs 30. The wire assembly receiving portion 22 may be made, at least partially, from any material capable of conducting electricity, and is preferably made of copper.

As illustrated in FIG. 2, electrical contact portion 24 is integral with wire assembly receiving portion 22. Electrical contact portion 24 is made at least partially from an electrically conductive material (preferably copper) and is electrically connected to wire assembly receiving portion 22 by its integral construction with wire assembly receiving portion 22. Electrical contact portion 24 and integral wire assembly receiving portion 22 may be manufactured using conventional metal stamping techniques including punching and folding to obtain the desired configuration. Alternatively, the electrical contact portion 24 may be separately manufactured from wire assembly receiving portion 22 and then attached to wire assembly receiving portion 22 using any attachment method effective to mechanically attach and electrically connect the two components.

Electrical contact portion 24 includes electrical contact portion protrusions 32. In the illustrated embodiment, two longitudinally oriented electrical contact portion protrusions 32 are depicted. Alternatively, a single electrical contact portion protrusion 32 may be utilized, or additional protrusions may be used. Further, the electrical contact portion protrusion 32 may be oriented laterally or otherwise. In the illustrated embodiment, electrical contact portion protrusion 32 have been partially cut from a surface 34 of the electrical contact portion 24 and protrude in an upwards direction (from the perspective of FIG. 2). In other embodiments, the electrical contact portion protrusions 32 may be attached to surface 34. Electrical contact portion protrusions 32 may be made, at least partially, from an electrically conductive material, preferably copper. Electrical contact portion 24 further includes a snap fit appendage 36 to engage and secure the spring portion 26.

Spring portion 26 includes a spring portion protrusion 38 protruding in a generally downward direction (from the perspective of FIG. 2) from a surface 40 of spring portion 26. As illustrated, spring portion protrusion 38 may be a section of surface 40 that is deformed so as to protrude in a downward direction. Alternatively, spring portion protrusion 38 may be attached to the underside of surface 40. In the illustrated embodiment, a portion of side 42 may be bowed in to accommodate the deformation caused when spring portion protrusion 38 is formed in surface 40. Spring portion 26 further includes a snap fit receiver 44 to engage the snap fit appendage 36 on the electrical contact portion 24. In other embodiments, spring portion 26 may have a snap fit appendage and electrical contact portion 24 may have a snap fit receiver. Alternatively, other methods of engagement between spring portion 26 and electrical contact portion 24 may be utilized such as tabs/slots, interlinking configurations, adhesives and the like.

Spring portion 26 may further include a connector appendage 46 which may be used to secure the electrical terminal assembly 10 to the component 14. In other embodiments, connector appendage 46 may be attached to the electrical contact portion 24. In still other embodiments, a connector appendage may be attached to electrical component 14 with a corresponding receiver associated with either spring portion 26 or electrical contact portion 24.

Figure 3:
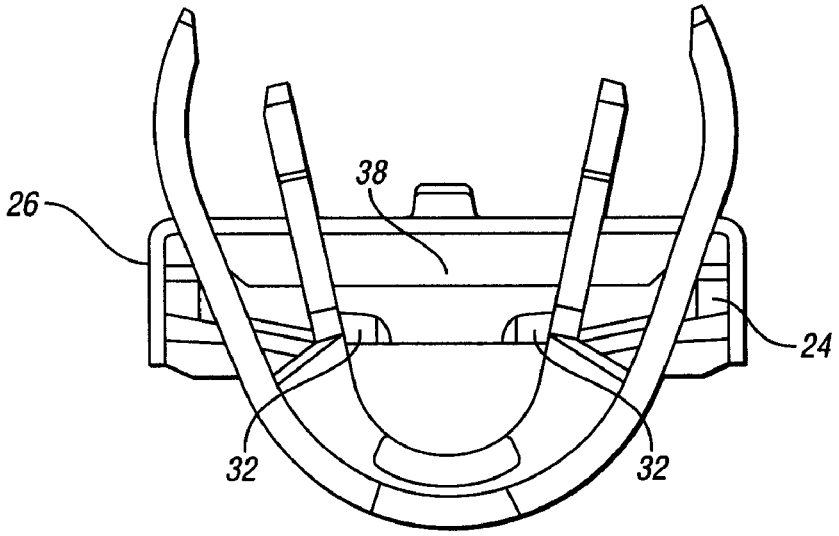
FIGS. 3 and 4 are longitudinal side views of alternate embodiments of the electrical terminal assembly of FIG. 2.
Figure 4:
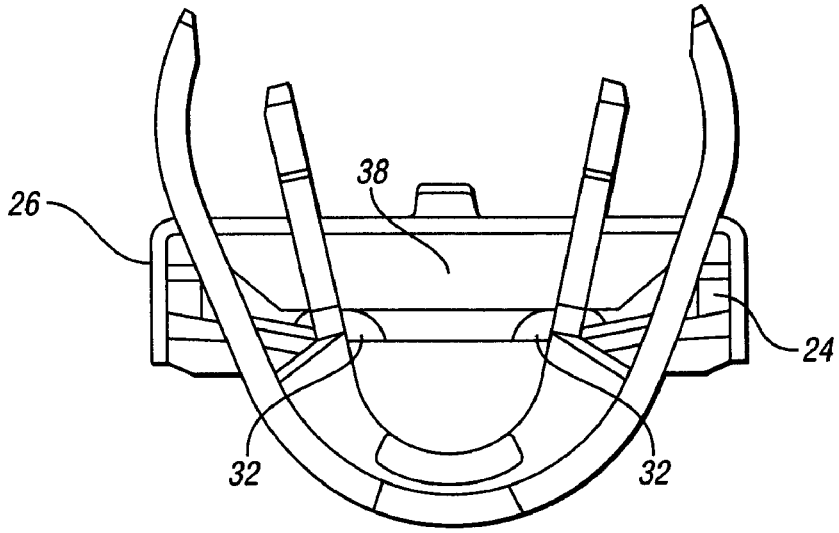
Figure 5:
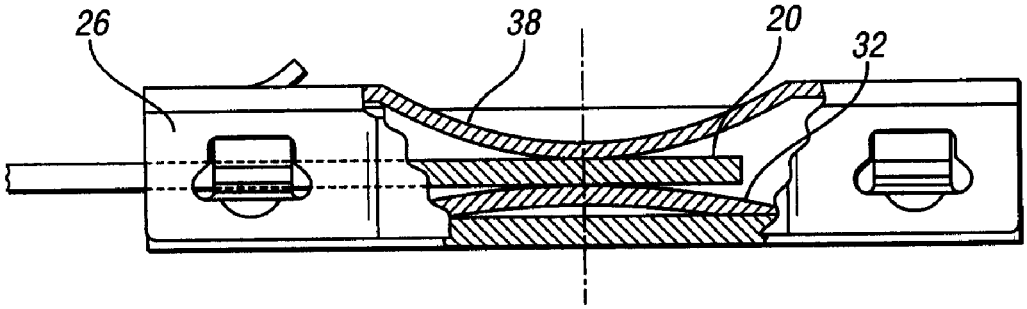
FIG. 5 is a fragmented cutaway side view of the electrical terminal assembly of FIG. 2 engaging and securing a male connector.

When spring portion 26 is attached to electrical contact portion 24, they cooperate to form a female receiver 48 (FIG. 1) for receiving the male connector 20. In at least one embodiment, when spring portion 26 is connected to electrical contact portion 24, electrical contact portion protrusion 32 and spring portion protrusion 38 are disposed proximate to, but spaced apart from one another (see FIG. 3). In other embodiments, electrical contact portion protrusion 32 and spring portion protrusion 38 are in physical contact when spring portion 26 is attached to electrical contact portion 24 (see FIG. 4). In both embodiments, male connector 20 may be inserted into female receiver 48 and may be engaged and secured in an interference fit with male connector 20 sandwiched between spring portion protrusion 38 and electrical contact portion protrusion 32, as best shown in FIG. 5.

Figure 6:
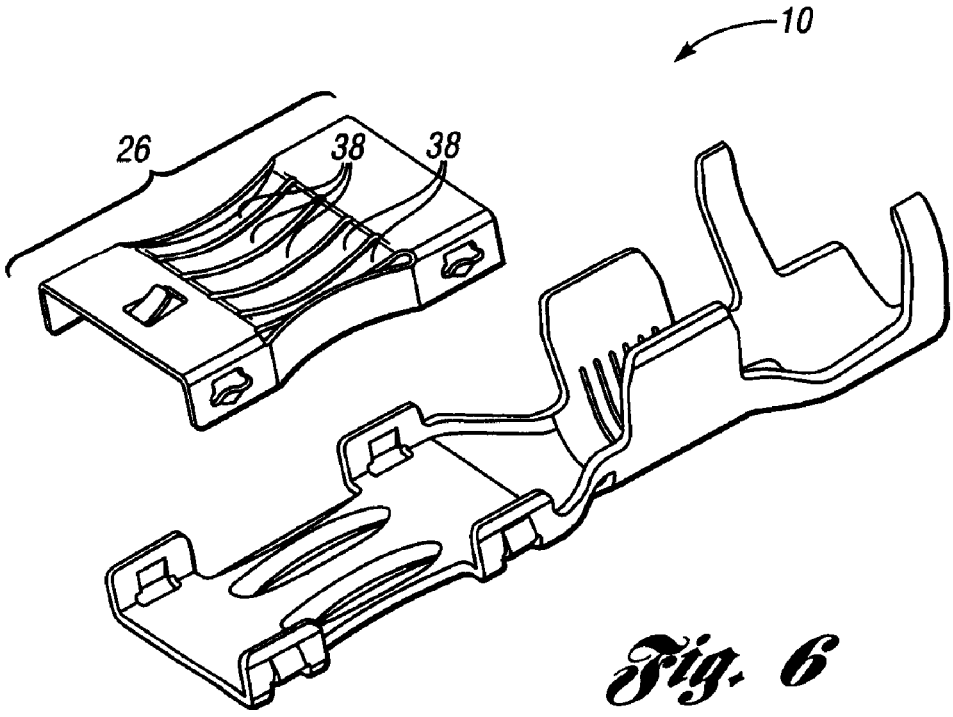
FIG. 6 is an exploded view of an alternate embodiment of the electrical terminal assembly of FIG. 2.

FIG. 6 illustrates an alternate embodiment of electrical terminal assembly 10 wherein spring portion 26 includes a plurality of spring portion protrusions 38. As illustrated, the plurality of spring portion protrusions 38 are spaced apart, substantially uniform and substantially aligned. By having a plurality of spaced apart substantially uniform and substantially aligned spring portion protrusions 38, less force may be required to insert male connector 20 into female receiver 48 as compared with the force required to insert male connector 20 into female receiver 48 where the electrical terminal assembly 10 has a single protrusion such as the embodiment of spring portion 26 illustrated in FIG. 2.

Figure 7:
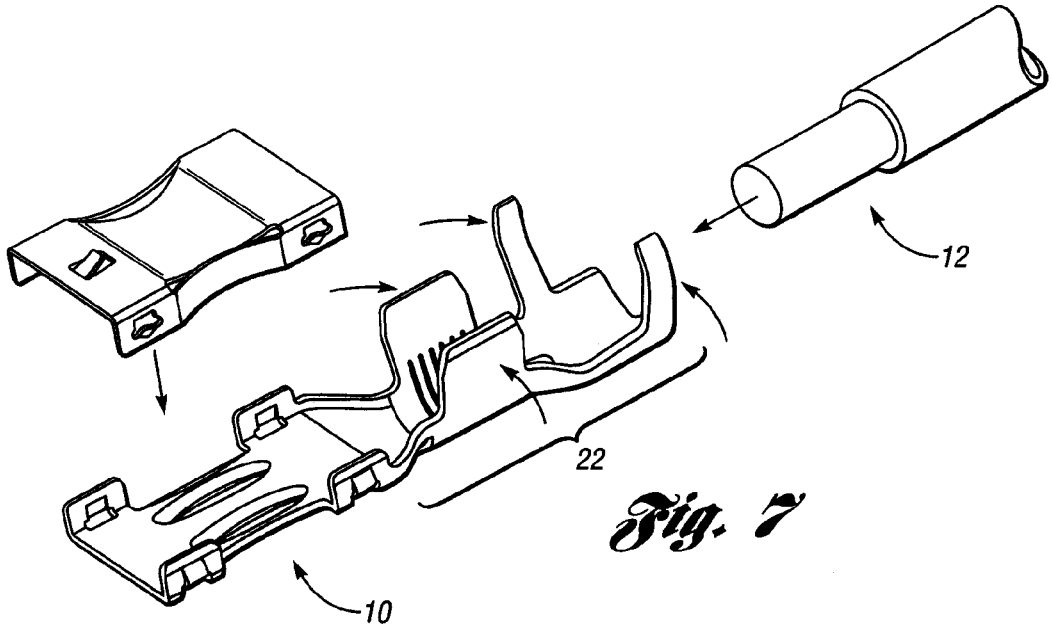
FIGS. 7 through 9 are perspective views of the electrical terminal assembly illustrating a sequence of steps for using the electrical terminal assembly.
Figure 8:
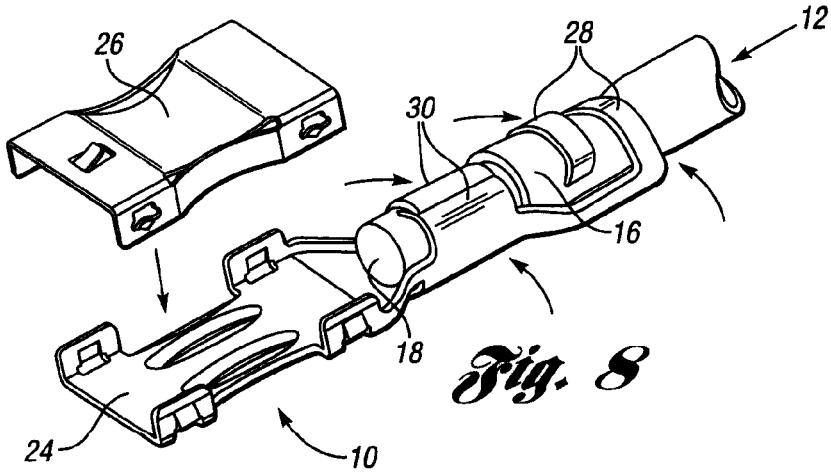
Figure 9:
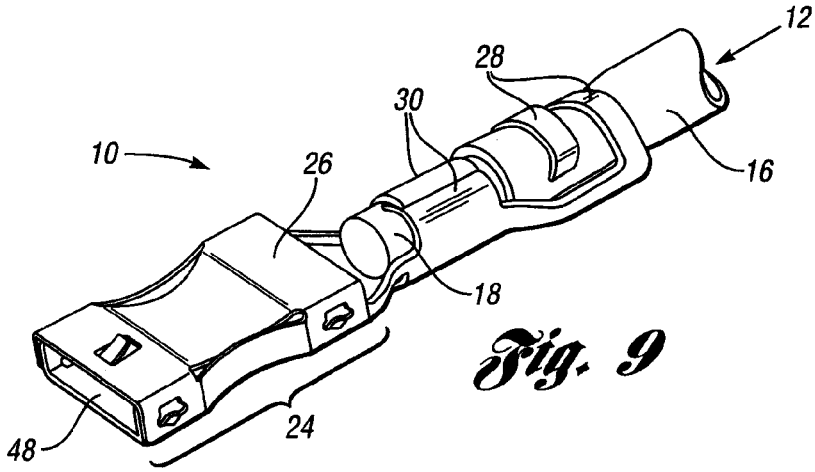

FIGS. 7 through 9 illustrate the method of using the electrical terminal assembly 10. In FIG. 7, wire assembly 12 is placed in the wire assembly receiving portion 22. In FIG. 8, the first set of prongs 28 is crimped around the insulated portion 16 of wire assembly 12 and the second set of prongs 30 is crimped around the uninsulated portion 18 of wire assembly 12. The step of attaching spring portion 26 to electrical contact portion 24 is also illustrated in FIG. 8. In FIG. 9, the completed electrical terminal assembly 10 is illustrated showing the first set of prongs 28 and the second set of prongs 30 in their crimped configuration about the insulated portion 16 and the uninsulated portion 18, respectively, of wire assembly 12. Spring portion 26 is illustrated attached to electrical contact portion 24 to form female receiver 48. In this configuration, the electrical terminal assembly is ready to receive male component 20 of electrical component 14 (not shown).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical terminal assembly comprising:

a wire assembly receiving portion adapted to receive a wire assembly, the wire assembly receiving portion including a first set of prongs configured to crimp around an insulated portion of the wire assembly, wherein the first set of prongs includes first and second prongs that are mutually spaced in a longitudinal direction of the wire assembly receiving portion;

an electrical contact portion having an electrical contact portion protrusion that extends from a surface of the electrical contact portion, the electrical contact portion being electrically connected to the wire assembly receiving portion; and a spring portion adapted for engagement with the electrical contact portion, the spring portion and the electrical contact portion cooperating to form a female receiver therebetween for engaging and securing a male connector through an interference fit between the spring portion, electrical contact portion protrusion and male connector when the spring portion and the electrical contact portion are engaged;

wherein the electrical contact portion protrusion extends toward and contacts the spring portion when the spring portion and the electrical contact portion are engaged.

2. The electrical terminal assembly of claim 1 wherein the spring portion is made at least partially from an electrically conductive material.

3. The electrical terminal assembly of claim 2 wherein the spring portion is made at least partially of steel.

4. The electrical terminal assembly of claim 1 wherein the electrical contact portion is integral with the wire assembly receiving portion.

5. The electrical terminal assembly of claim 4 wherein the electrical contact portion and the wire assembly receiving portion are made at least partially of copper.

6. The electrical terminal assembly of claim 1 wherein the electrical contact portion and the wire assembly receiving portion are made at least partially of copper.

7. The electrical terminal assembly of claim 6 wherein the spring portion is made at least partially of steel.

8. The electrical terminal assembly of claim 1 wherein the spring portion includes a bowed side.

9. The electrical terminal assembly of claim 8 wherein the bowed side is configured to accommodate deformation associated with the spring portion protrusion.

10. The electrical terminal assembly of claim 1 wherein the spring portion has a spring portion protrusion extending from a surface of the spring portion toward the electrical contact portion, the spring portion protrusion and the electrical contact portion are configured to engage and secure the male connector within the female receiver.

11. The electrical terminal assembly of claim 10 wherein the spring portion protrusion contacts the electrical contact portion when the spring portion and the electrical contact portion are engaged and wherein the female receiver is configured to secure the male connector through an interference fit between the electrical contact portion, the spring portion protrusion and the male connector.

12. The electrical terminal assembly of claim 11 wherein the electrical contact portion has an electrical contact portion protrusion extending from a surface of the electrical contact portion toward the spring portion, the electrical contact portion protrusion being in contact with the spring portion protrusion when the spring portion and the electrical contact portion are engaged.

13. The electrical terminal assembly of claim 10 wherein the electrical contact portion has an electrical contact portion protrusion extending from a surface of the electrical contact portion toward the spring portion, the electrical contact portion protrusion being spaced apart from the spring portion protrusion when the spring portion and electrical contact portion are engaged.

14. The electrical terminal assembly of claim 1 wherein the electrical contact portion has a plurality of electrical contact portion protrusions extending from a surface of the electrical contact portion in a direction towards the spring portion.

15. The electrical terminal assembly of claim 1 wherein the spring portion has a plurality of spring portion protrusions extending from a surface of the spring portion toward the electrical contact portion.

16. The electrical terminal assembly of claim 1 wherein the spring portion is attachable to the electrical contact portion by a snap fit.

17. An electrical terminal assembly comprising:

a wire assembly receiving portion adapted to receive a wire assembly having an insulated portion and an uninsulated portion, the wire assembly portion having a first set of prongs for crimping around the insulated portion of the wire assembly, and a second set of prongs for crimping around the uninsulated portion of the wire assembly, wherein the first set of prongs includes first and second prongs that are mutually spaced in a longitudinal direction of the wire assembly receiving portion such that the first prong is disposed proximate an end of the wire assembly receiving portion and the second prong is disposed between the first prong and the second set of prongs;

an electrical contact portion integral with the wire assembly receiving portion, the electrical contact portion having an electrical contact portion protrusion projecting from a surface of the electrical contact portion and a first snap fit feature disposed on a side wall that extends upwardly from the surface; and a spring portion having a spring portion protrusion protruding from a surface of the spring portion toward the electrical contact portion, the spring portion protrusion being spaced apart from the electrical contact portion protrusion, the spring portion and the electrical contact portion forming a female receiver configured to receive and secure to a male connector, and a second snap fit feature disposed on a side of the spring portion that extends downwardly from the surface of the spring portion;

wherein the electrical contact portion and the spring portion are snap fit together when the first snap fit feature and second snap fit feature are engaged;

the spring portion further comprises a bowed wall disposed between a pair of second snap fit features.

18. The electrical terminal assembly of claim 17 wherein the spring portion protrusion is composed of a plurality of substantially uniform, substantially aligned protrusion portions.

19. The electrical terminal assembly of claim 17 wherein the electrical contact portion has a plurality of spaced apart electrical contact portion protrusions.

* * * * *